US005664808A

United States Patent [19]

Whidden et al.

[11] Patent Number: 5,664,808

[45] Date of Patent: Sep. 9, 1997

[54] SKI AND SNOWBOARD EDGE COVERING DEVICE

[76] Inventors: Brian F. Whidden; Alexis Whidden, both of 5080 Guildwood Way, Mississauga, Ontario, Canada, L5R 2R6

[21] Appl. No.: 662,795

[22] Filed: Jun. 12, 1996

[51] Int. Cl.[6] ..... A63C 11/02

[52] U.S. Cl. ..... 280/815; 150/154; 280/809

[58] Field of Search ..... 280/809, 815, 280/814, 825, 811; 150/154, 166

[56] References Cited

U.S. PATENT DOCUMENTS 4,002,349 1/1977 Dopp ..... 280/814

4,006,912 2/1977 Perlich et al. ..... 280/825

4,012,050 3/1977 Miller ..... 280/825

4,830,403 5/1989 Ohmori ..... 280/814

*Primary Examiner*—Eric D. Culbreth

[57] ABSTRACT

A device for covering and protecting edges of a snow ski or snowboard. The inventive device includes lateral edge covers which can be frictionally engaged to opposed longitudinal edges of a ski or snowboard. A tip cover extends between upper ends of the lateral edge covers for coveting the tip of the ski or snowboard. The device may be configured to extend around all outer peripheral edges of a ski or snowboard.

2 Claims, 3 Drawing Sheets

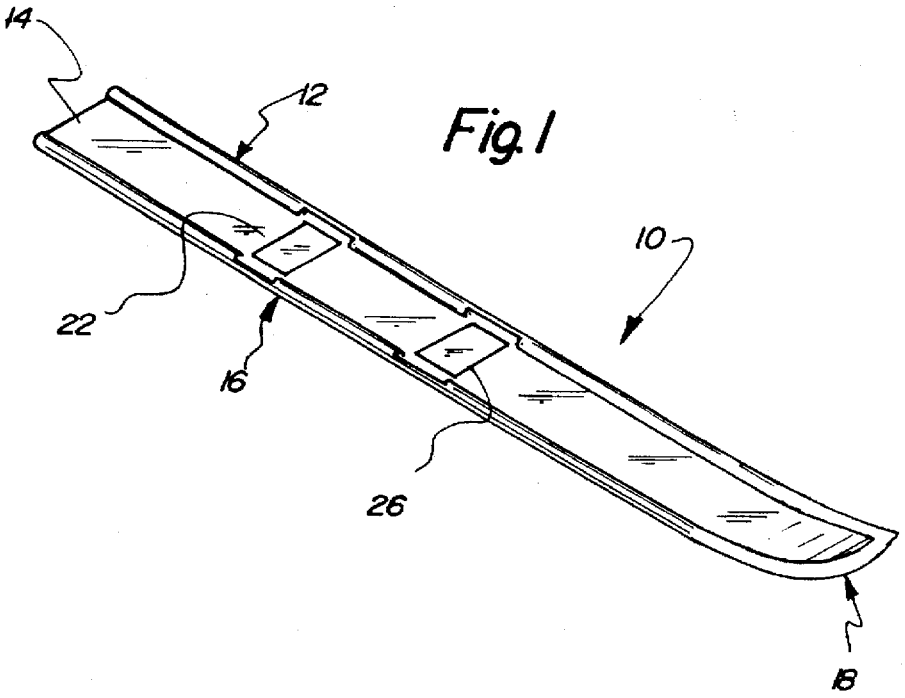
Fig. 1
Fig. 2
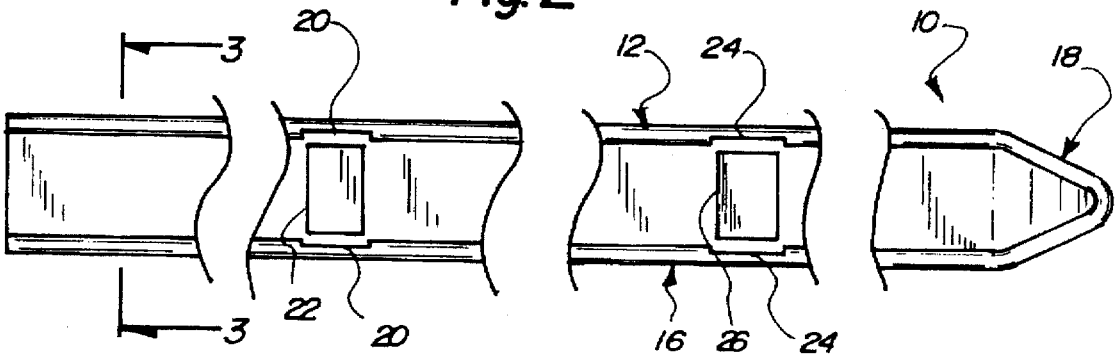

SKI AND SNOWBOARD EDGE COVERING DEVICE

BACKGROUND OF THE INVENTION

1. Field of the Invention

The present invention relates to snow ski or snowboard structures and more particularly pertains to a ski and snowboard edge coveting device for covering and protecting edges of a snow ski or snowboard.

2. Description of the Prior Art

The use of snow ski or snowboard structures is known in the prior art. More specifically, snow ski or snowboard structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art snow ski or snowboard structures include U.S. Pat. Nos. 3,480,894; U.S. Pat. No. 4,778,710; U.S. Pat. No. 4,175,766; U.S. Pat. No. 3,918,728; U.S. Pat. No. 3,907,314; and U.S. Pat. No. 3,751,054.

While these devices fulfill their respective, particular objectives and requirements, the aforementioned patents do not disclose a ski and snowboard edge covering device for covering and protecting edges of a snow ski or snowboard which includes lateral edge covers frictionally engagable to longitudinal edges of a ski or snowboard, and a tip cover extending between upper ends of the lateral edge covers for covering the tip of a ski or snowboard when the device is installed relative thereinto.

In these respects, the ski and snowboard edge coveting device according to the present invention substantially departs from the conventional concepts and designs of the prior art, and in so doing provides an apparatus primarily developed for the purpose of covering and protecting edges of a snow ski or snowboard.

SUMMARY OF THE INVENTION

In view of the foregoing disadvantages inherent in the known types of snow ski or snowboard structures now present in the prior art, the present invention provides a new ski and snowboard edge covering device construction wherein the same can be utilized for coveting and protecting edges of a snow ski or snowboard. As such, the general purpose of the present invention, which will be described subsequently in greater detail, is to provide a new ski and snowboard edge covering device apparatus and method which has many of the advantages of the snow ski or snowboard structures mentioned heretofore and many novel features that result in a ski and snowboard edge covering device which is not anticipated, rendered obvious, suggested, or even implied by any of the prior art snow ski or snowboard structures, either alone or in any combination thereof.

To attain this, the present invention generally comprises a device for coveting and protecting edges of a snow ski or snowboard. The inventive device includes lateral edge covers which can be frictionally engaged to opposed longitudinal edges of a ski or snowboard. A tip cover extends between upper ends of the lateral edge covers for coveting the tip of the ski or snowboard. The device may be configured to extend around all outer peripheral edges of a ski or snowboard.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ski and snowboard edge coveting device apparatus and method which has many of the advantages of the snow ski or snowboard structures mentioned heretofore and many novel features that result in a ski and snowboard edge coveting device which is not anticipated, rendered obvious, suggested, or even implied by any of the prior art tool guides, either alone or in any combination thereof.

It is another object of the present invention to provide a new ski and snowboard edge covering device which may be easily and efficiently manufactured and marketed.

It is a further object of the present invention to provide a new ski and snowboard edge covering device which is of a durable and reliable construction.

An even further object of the present invention is to provide a new ski and snowboard edge coveting device which is susceptible of a low cost of manufacture with regard to both materials and labor, and which accordingly is then susceptible of low prices of sale to the consuming public, thereby making such ski and snowboard edge coveting devices economically available to the buying public.

Still yet another object of the present invention is to provide a new ski and snowboard edge coveting device which provides in the apparatuses and methods of the prior art some of the advantages thereof, while simultaneously overcoming some of the disadvantages normally associated therewith.

Still another object of the present invention is to provide a new ski and snowboard edge coveting device for covering and protecting edges of a snow ski or snowboard.

Yet another object of the present invention is to provide a new ski and snowboard edge coveting device which includes lateral edge covers frictionally engagable to longitudinal edges of a ski or snowboard, and a tip cover extending between upper ends of the lateral edge covers for coveting the tip of a ski or snowboard when the device is installed relative thereinto.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a ski and snowboard edge covering device according to the present invention in use.

FIG. 2 is a top plan view of the invention in use.

DESCRIPTION OF THE PREFERRED EMBODIMENT

Figure 3:
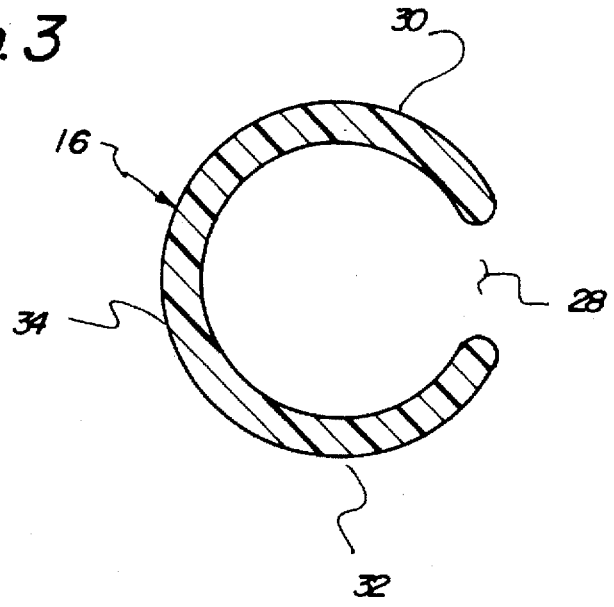
FIG. 3 is a cross-sectional view taken along line 3—3 of FIG. 2.

With reference now to the drawings, and in particular to FIGS. 1–6 thereof, a new ski and snowboard edge covering device embodying the principles and concepts of the present invention and generally designated by the reference numeral 10 will be described.

Figure 5:
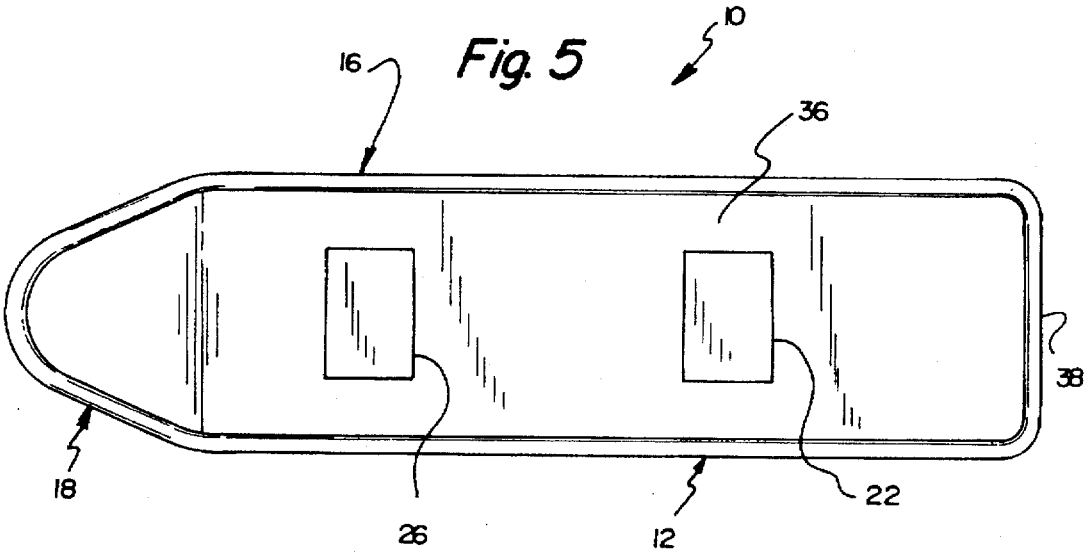
FIG. 5 is a top plan view of the invention configured for use with a snowboard.

More specifically, it will be noted that the ski and snowboard edge coveting device 10 comprises a first lateral edge cover 12 frictionally engagable to a ski 14, or snowboard 36 as shown in FIG. 5, so as to cover a first longitudinal lateral edge thereof. A second lateral edge cover 16 can be frictionally engaged to the ski 14 so as to cover a second longitudinal lateral edge thereof. A tip edge cover 18 extends between upper ends of the lateral edge covers 12 and 16 and can be frictionally engaged to the ski 14 so as to cover a tip edge thereof extending between the opposed longitudinal lateral edges of the ski. By this structure, the edges of the ski 14 are protected from unintentional engagement with surrounding objects which could damage the ski or such objects.

Figure 4:
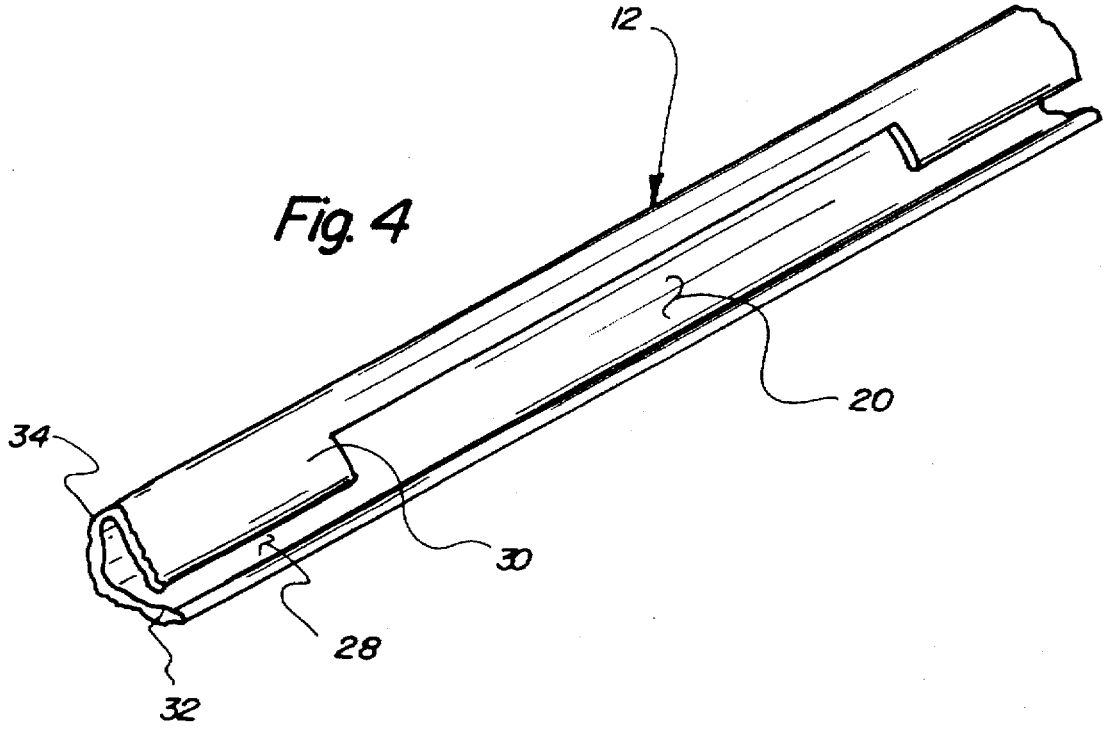
FIG. 4 is an enlarged isometric illustration of a portion of the present invention.

Referring now to FIGS. 2 through 4 wherein the present invention 10 is illustrated in detail, it can be shown that each of the lateral edge covers 12 and 16 may be shaped so as to define a first binding clearance aperture 20 directed laterally into an upper surface thereof for providing clearance of the lateral edge cover relative to a first binding 22 of the ski 14. Additionally, the lateral edge covers 12 and 16 may be further shaped so as to define second binding clearing apertures 24 directed laterally into an upper surface thereof which provide for clearance of a second binding 26 attached to the ski 14. By this structure, the lateral edge covers 12 and 16 can be configured so as to extend at least partially onto upper and lower surfaces of the ski 14 without interfering with the bindings 22 and 26 thereof.

Referring now to FIG. 3, it can be shown that each of the edge covers 12, 16, and 18 is comprised of an unlabelled elongated cylindrical panel member having a slot 28 directed laterally thereinto permitting a lateral insertion of the respective edge portion of the ski 14 into the cylindrical channel. To this end, the cylindrical channel member includes an elongated upper arcuate portion 30 spaced from an elongated lower arcuate portion 32 with an elongated outer arcuate portion 34 extending between the upper and lower arcuate portions so as to define the cylindrical channel member of the second lateral edge cover 16 illustrated in FIG. 3 of the drawings. It should be noted that the edge covers 12, 16, and 18 are all substantially similar in their cross-sectional view as shown in FIG. 3 of drawings for the second lateral edge cover 16. By this structure, the elongated upper arcuate portion 30 can be positioned onto an upper surface of the ski 14, with the elongated lower arcuate portion 32 being positioned onto a lower surface of the ski, whereby the elongated outer arcuate portion 34 biases the upper arcuate portion 30 towards the lower arcuate portion 32 so as to create a frictional engagement between the upper and lower arcuate portions 30 and 32 and the respective upper and lower surfaces of the ski 14 which operates to retain the respective edge cover 12, 16, or 18 relative to the ski 14.

As shown for a first binding clearance aperture 20 of the first lateral edge cover 12 within FIG. 4 of the drawings, it can be shown that the binding clearance apertures 20 and 24 are each directed into the upper arcuate portion 30 of the elongated cylindrical channel member of the respective edge cover 12 or 16.

Figure 6:
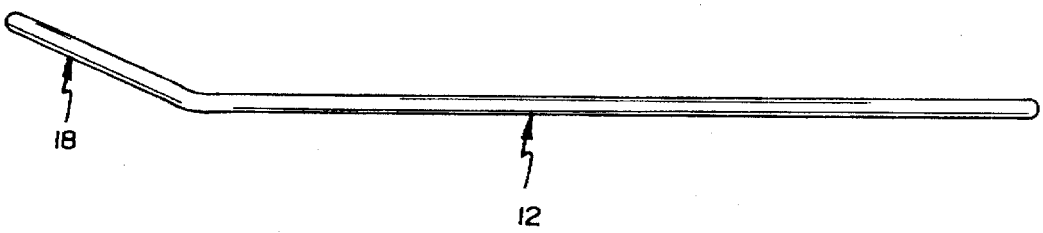
FIG. 6 is a side elevational view of the embodiment illustrated in FIG. 5.

Referring now to FIGS. 5 and 6, it can be shown that the present invention 10 can be configured to fit about all or a portion of the outer peripheral edge of a snowboard 36. In this configuration of the invention 10, the first lateral edge cover 12 is similarly frictionally engagable with a first longitudinal lateral edge of the snowboard 36. The second lateral edge cover 16 can also be frictionally engaged to the second longitudinal lateral edge of the snowboard 36. The tip edge cover 18 extends between upper ends oft he lateral edge covers 12 and 16 and can be frictionally engaged to the snowboard 36 to cover the tip edge thereof. Since a snowboard is generally wider than a ski 14, the tip edge cover 18 will correspondingly be substantially wider than the tip edge cover 18 utilized for covering the ski 14 as shown in the previous figures. To further protect the snowboard 36, or the ski 14 if so desired, the invention 10 may include a tail edge cover 38 extending between lower ends of the lateral edge covers 12 and 16 which can be frictionally engaged to the ski 14 or snowboard 36 so as to cover a tail edge thereof extending between the opposed longitudinal lateral edges of the ski or snowboard. By this structure, the edges of the snowboard 36 are protected from unintentional engagement with surrounding objects.

In use, the ski and snowboard edge covering device 10 of the present invention can be easily utilized for covering and protecting longitudinal lateral and tip edges of an associated ski 14 or snowboard 36 when the device 10 is installed as shown in FIG. 1 or FIG. 5 of the drawings. The present invention 10 thus serves to eliminate damage to the ski 14 and/or surrounding objects when the ski is unintentionally engaged with such surrounding objects.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A ski edge covering device of comprising:

a first lateral edge cover frictionally engagable to a ski so as to cover a first longitudinal lateral edge thereof;

a second lateral edge cover frictionally engagable to the ski so as to cover a second longitudinal lateral edge thereof;

a tip edge cover extending between upper ends of the lateral edge covers which can be fictionally engaged to the ski so as to cover a tip edge thereof extending between the first and second longitudinal lateral edges of the ski;

each of the lateral edge covers is shaped so as to define a first binding clearance aperture directed laterally into an upper surface of the lateral edge cover for providing clearance of the lateral edge cover relative to a first binding of the ski, each of the lateral edge covers is further shaped so as to define a second binding clearing aperture directed laterally into the upper surface thereof which provides for clearance of a second binding of the ski; and an elongated cylindrical channel member being formed within each of the edge covers, the elongated cylindrical channel member having a slot directed laterally thereinto permitting a lateral insertion of the respective edge portion of the ski into the cylindrical channel, the cylindrical channel members each includes an elongated upper arcuate portion and an elongated lower arcuate portion spaced from the elongated upper arcuate portion, with an elongated outer arcuate portion extending between the upper and lower arcuate portions so as to define the cylindrical channel member of the respective lateral edge cover, wherein the elongated upper arcuate portion can be positioned onto an upper surface of the ski, with the elongated lower arcuate portion being positionable onto a lower surface of the ski, whereby the elongated outer arcuate portion biases the upper arcuate portion towards the lower arcuate portion so as to create a frictional engagement between the upper and lower arcuate portions and the respective upper and lower surfaces of the ski which retains the respective edge cover relative to the ski, the binding clearance apertures are each directed into the upper arcuate portion of the elongated cylindrical channel member of the respective edge cover.

2. A ski edge covering device comprising:

a ski having a first and second longitudinal lateral edges, and a tip edge;

a first lateral edge cover frictionally engaged to the ski so as to cover the first longitudinal lateral edge thereof;

a second lateral edge cover frictionally engaged the ski so as to cover the second longitudinal lateral edge thereof;

a tip edge cover extending between upper ends of the lateral edge covers and frictionally engaged to ski so as to cover the tip edge thereof extending between the first and second longitudinal lateral edges of the ski;

each of the lateral edge covers is shaped so as to define a first binding clearance aperture directed laterally into an upper surface of the lateral edge cover for providing clearance of the lateral edge cover relative to a first binding of the ski, each of the lateral edge covers is further shaped so as to define a second binding clearing aperture directed laterally into the upper surface thereof which provides for clearance of a second binding of the ski, each of the edge covers is comprised of an elongated cylindrical channel member having a slot directed laterally thereinto permitting a lateral insertion of the respective edge portion of the ski into the cylindrical channel; and the cylindrical channel members each includes an elongated upper arcuate portion and an elongated lower arcuate portion spaced from the elongated upper arcuate portion, with an elongated outer arcuate portion extending between the upper and lower arcuate portions so as to define the cylindrical channel member of the respective lateral edge cover, wherein the elongated upper arcuate portion is positioned onto an upper surface of the ski, with the elongated lower arcuate portion being positioned onto a lower surface of the ski, whereby the elongated outer arcuate portion biases the upper arcuate portion towards the lower arcuate portion so as to create a frictional engagement between the upper and lower arcuate portions and the respective upper and lower surfaces of the ski which retains the respective edge cover relative to the ski, the binding clearance apertures are each directed into the upper arcuate portion of the elongated cylindrical channel member of the respective edge cover.

* * * * *